US005762434A

United States Patent [19]

Nagashima et al.

[11] Patent Number: 5,762,434

[45] Date of Patent: Jun. 9, 1998

[54] BALL POINT PEN TIP AND PRODUCTION METHOD THEREOF

[75] Inventors: Kousuke Nagashima; Hiroyuki Saito, both of Ishioka, Japan

[73] Assignee: Pentel Kabushiki Kaisha, Japan

[21] Appl. No.: 619,487

[22] PCT Filed: Aug. 2, 1995

[86] PCT No.: PCT/JP95/01529

§ 371 Date: Mar. 22, 1996

§ 102(e) Date: Mar. 22, 1996

[87] PCT Pub. No.: WO96/05073

PCT Pub. Date: Feb. 22, 1996

[30] Foreign Application Priority Data

| | | | |
|---|---|---|---|
| Aug. 10, 1994 | [JP] | Japan | 6-209102 |
| Aug. 10, 1994 | [JP] | Japan | 6-209103 |
| Sep. 9, 1994 | [JP] | Japan | 6-241822 |
| Sep. 9, 1994 | [JP] | Japan | 6-241824 |

[51] Int. Cl.[6] ..... B43K 1/08

[52] U.S. Cl. ..... 401/209

[58] Field of Search ..... 401/209, 208, 401/213

[56] References Cited

U.S. PATENT DOCUMENTS

| | | | |
|---|---|---|---|
| 4,726,845 | 2/1988 | Thompson et al. | 106/25 |

FOREIGN PATENT DOCUMENTS

| | | |
|---|---|---|
| 57-191099 | 11/1982 | Japan . |
| 61-205193 | 9/1986 | Japan . |
| 63-114695 | 5/1988 | Japan . |
| 63-252799 | 10/1988 | Japan . |
| 64-031699 | 2/1989 | Japan . |
| 3193230 | 8/1991 | Japan . |

*Primary Examiner*—William E. Stoll
*Attorney, Agent, or Firm*—Adams & Wilks

[57] ABSTRACT

A method of manufacturing a ball point pen tip comprises providing a body member having a distal end portion and a ball holding portion and disposing a ball in the ball holding portion. Caulked portions having different angles are formed throughout the entire periphery of an outer surface of the distal end portion of the body member using a caulking tool while bringing a pressure contact portion of the caulking tool into contact with the ball.

15 Claims, 4 Drawing Sheets

BALL POINT PEN TIP AND PRODUCTION METHOD THEREOF

BACKGROUND OF THE INVENTION

This invention relates to a ball point pen tip having the structure wherein a reduced diameter portion is formed by caulking inward a distal butt end portion of a taper surface whose diameter progressively decreases towards a distal end, and a ball as a writing member is allowed to partly protrude from an opening while being held by a ball holding portion as a part of an ink passage, and to a production method of such a ball point pen tip.

BACKGROUND INFORMATION

Ball point pens have been designed conventionally so that writing can be made mainly at a writing angle within the range of 90° to 50°. However, there is the case where writing is made at a smaller writing angle than the ordinary writing angle when Arabic characters or alphabets are written, and ball point pens capable of providing clear written characters even at such a small writing angle have been desired.

To attain writing at the small writing angle, the distal butt end portion of a ball point pen tip must not catch the surface of a to-be-written object such as a sheet of paper. This requirement can be satisfied by preventing the distal end portion of the ball point pen tip other than the ball from coming into contact with a written surface even when writing is made at a small writing angle. To prevent the contact of the distal end portion of the ball point pen tip with the written surface, it may be possible to set a caulking angle of a reduced diameter portion, which prevents fall-out of the ball, to a small angle, or to reduce the thickness of the distal end portion of the ball point pen tip. However, when the thickness of the distal end portion is reduced or the caulking angle of the distal butt end portion is set to a small caulking angle, machining with a large deformation quantity must be carried out in comparison with the case where machining is made at a large caulking angle, in order to obtain a diameter reduction quantity necessary for holding the ball. In this case, adverse influences are exerted on the inner surface of the reduced diameter portion as a portion corresponding to the caulked portion of an ink passage and the shape of the distal butt end is likely to become non-uniform. In consequence, uniform supply of ink to the written surface or uniform rotation of the ball is impeded and a non-uniform density occurs in written characters. When the distal end shapes of the butt end are not uniform, a portion which is unnecessarily elongated than required is formed towards the distal end side, and the ball is likely to come into contact with the written surface at a small writing angle.

From the aspect of production methods, a production method of a ball point pen tip is known which comprises forming interior components of a ball point pen tip such as a center hole, a ball chamber, etc, so as to hold a ball of the metallic ball point pen tip made of a metal such as brass, german silver, stainless steel, copper alloy and aluminum alloy, loading then the ball into the ball chamber and caulking inward a distal butt end portion so as to hold the ball. The caulked portion formed at the distal butt end portion for holding the ball greatly affects writing quality of the ball point pen such as a hand writing condition and catch with a sheet surface.

This caulking working of the ball point pen tip is effected by bringing a pressure contact member into pressure contact with the ball point pen tip, and ball point pen tips having various required quality have been worked by adjusting the angle at which the pressure contact surface of the pressure contact member comes into contact with the ball point pen tip (caulking angle).

When the caulking angle of the ball point pen tip and its caulking strength can be variously adjusted, variance of the angle and size of the caulked portion occurs in the product, and in order to keep required writing quality, strict check of defective products and strict control of the caulking angle must be made. In either case, job becomes more complicated.

Particularly in the case of the ball point pen tips where at least two, or a plurality of, stages of caulked portions having different angles are formed, some of the production methods according to the prior art generate non-uniform thickness portions at the boundary portions of a plurality of caulked portions having different angles due to elongation of the tip material caused by the caulking work, as typified by projections and fins, and these non-uniform portions catch the sheet surface and blank portions where ink is not applied occur in hand-written characters.

SUMMARY OF THE INVENTION

It is an object of the present invention to provide an improved ball point pen tip which completely obviates the drawbacks with the prior art described above.

It is another object of the present invention to provide a novel production method of a ball point pen tip.

The ball point pen tip according to the first embodiment of the present invention has the following structure. Namely, (1) the angle defined between a tangent coming into contact with a ball and with a ball point pen tip and a center line of the ball point pen tip is within the range of 3020 to 50°, (2) corner portions formed by caulking the ball point pen tip (boundary line between the portion with which a caulking tool comes into contact and the portions with which it does not) and corner portions at the foremost tip portion of the ball point pen tip exist at portions other than portions in contact with the tangent of the ball point pen described above, and (3) the length of a portion (ink control portion) formed when a part near the opening of the inner surface of the ball point pen tip comes into pressure contact with the ball, in the longitudinal direction, is 15 to 35% of the diameter of the ball from the end of the opening during caulking.

In a ball point pen tip of the type wherein a butt end portion at a distal end portion of a taper surface the diameter of which progressively decreases towards the distal end is caulked inward in such a manner as to form a reduced diameter portion and a ball as a writing member is held by a ball holding portion as a part of an ink passage in such a manner that a part of the ball protrudes from an opening, the ball point pen tip according to another embodiment of the present invention has the construction wherein the reduced diameter portion comprises first and second caulked portions having mutually different caulking angles, and a caulking angle $\alpha$ of the first caulked portion on the distal butt end side, a caulking angle $\beta$ of the second caulked portion, the diameter reduction angle $\gamma$ of the taper surface, the diameter D of the ball, the projection height h of the ball from the opening and the distance t between the outer shape of the distal butt end portion at the opening and the outer shape of the ball satisfy the following relations (1) to (4):

$$0.25 \leqq h \leqq 0.35D \quad (1)$$

$$0.007\ \text{mm} \leqq t \leqq 0.030\ \text{mm} \quad (2)$$

$$\gamma+10° \leqq \beta \leqq \gamma+40° \quad (3)$$

$$\beta+10^\circ \leq \alpha \leq \beta+40^\circ \quad (4)$$

To prevent the butt end of the ball point pen tip from coming into contact with the written surface even at a small writing angle, the ball projection height (h), the distance (t) between the outer shape of the distal butt end portion in the opening and the outer shape of the ball, and the caulking angle should be adjusted. The value (t) which prevents at least the distal butt end portion of the ball point pen tip at the opening from coming into contact with the written surface changes in accordance with the writing angle (θ), the ball diameter (D) and the ball height (h). The distance (t) between the outer shape of the distal butt end portion at the opening and the outer shape of the ball can be expressed by the writing angle (θ), the ball diameter (D) and the ball projection height (h) as the following formula (5). Incidentally, the term "writing angle (θ)" represents the minimum desired writing angle among the angles defined between the longitudinal direction of the writing instrument and the written surface:

$$t = \tan\theta(h - D/2) + D/2\sqrt{1+\tan^2\theta} - \sqrt{hD - h^2} \quad (5)$$

The formation of the reduced diameter portion by caulking the distal butt end portion of the ball point pen tip means and provides not only the prevention of fall-off of the ball but also the formation of an ink supply control portion on the inner wall of the ball holding portion. This ink supply control portion regulates the push force of the caulking working, brings the ball into contact with the inner wall of the ball holding portion and forms a smooth portion around a part of the inner wall of the ball holding portion having a uniform clearance from the ball. This portion makes transfer of ink to the ball surface uniform and easy and supplies uniformly ink transferred to the ball to the written surface. (Hereinafter, the smooth portion formed around the inner wall of the ball holding portion and having a uniform clearance from the ball will be referred to as the "ink control portion".)

In other words, because the ink control portion is formed, written characters which are least affected by the writing direction and the writing angle and have a uniform density can be obtained. As a result of intensive studies, the inventors of the present invention have found out that written characters having a uniform density can be obtained with the minimum influences of the writing direction and the writing angle of the ink control portion, and the uniform formation of the shape of the distal end portion of the ball point pen tip is greatly affected by the caulking angle of the distal butt end portion of the ball point pen tip, and have thus succeeded in obtaining the ball point pen tip which is free from catch with the written surface even at a small writing angle and can obtain beautiful characters having a uniform density.

In a production method of a ball point pen tip for forming a plurality of caulked portions having different angles on the outer surface of the distal butt end portion of a metallic ball point pen tip throughout the full periphery for holding the ball, the production method of the ball point pen tip according to the present invention comprises bringing a pressure contact portion of a caulking tool for forming the caulked portions into contact with the ball during the caulking working.

In the production method described above, the pressure contact portion of the caulking tool comprises a plurality of continuous pressure contact surfaces having different caulking angles, and when these pressure contact surfaces are brought into pressure contact with the ball point pen tip, a plurality of caulked portions having different angles can be simultaneously formed in one production step. In this case, a first pressure contact surface of the pressure contact portion on the butt end side, which comes into contact with the outer surface of the distal butt end portion of the ball point pen tip, may be shaped into a recessed curved surface.

The first pressure contact surface of the pressure contact portion on the butt end side, which comes into contact with the outer surface of the distal end portion of the ball point pen tip, can be shaped into a recessed curved surface.

The reduced diameter portion for holding the ball under the state in which the ball protrudes partly from an inner hole portion of the ball point pen tip can be formed, too, by bringing the contact surface of a rotary pressure contact member of caulking means into contact with a material while causing it to turn on its axis, rotating it round the material while a push deformation force is applied thereto, and moving the contact surface towards the distal end open portion.

Further, the present invention provides a production method of a ball point pen tip which forms a reduced diameter portion by applying caulking to the distal end so that a ball as a writing member can be held while partly protruding from an inner hole. This method can be practiced by causing a fine granular member to impinge against at least the reduced diameter portion after the ball is held so as to change corner portions into a curved surface.

The present invention further provides a production method of a ball point pen tip which forms a reduced diameter portion, and applies polishing to the distal end portion of the ball point pen tip holding the ball placed in an inner hole so as to form the outer shape of the distal end portion into a smooth curve, and this method can be practiced also by connecting a synthetic resin pipe as an ink tank to the ball point pen tip, rotating this synthetic resin pipe while holding it so as to rotate the ball point pen tip, causing the synthetic resin pipe to undergo deflection, and then bringing a polishing material into contact with the distal end portion for polishing under such a state.

DETAILED DESCRIPTION OF THE PREFERRED EMBODIMENTS

Hereinafter, an embodiment will be explained with reference to the drawings.

Figure 1:
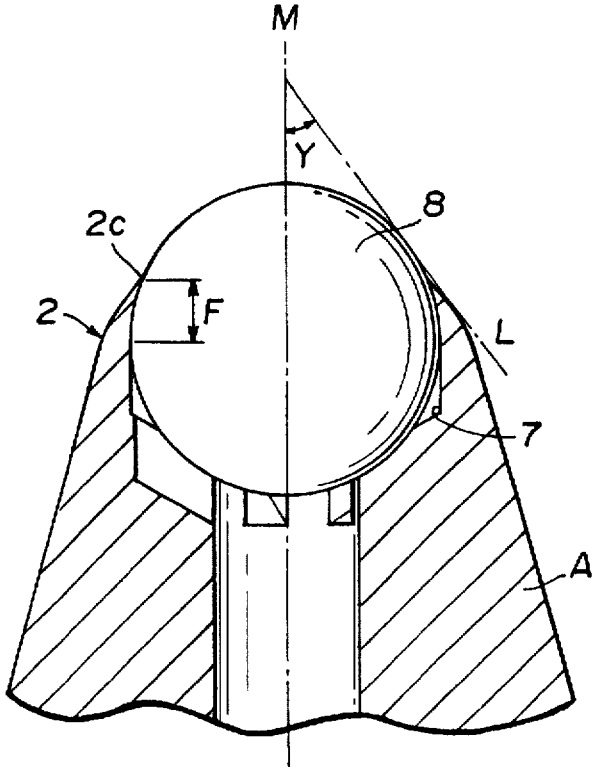
FIG. 1 is an explanatory view showing the structure of a ball point pen tip according to the first embodiment of the present invention.

The ball point pen tip according to the first embodiment of the present invention has the following structure shown in FIG. 1:

(1) angle Y defined between a tangent L coming into contact with a ball 8 and a body member or ball point pen tip A and a center line M of the ball point pen tip is within the range of 30° to 50°;

(2) a corner portion 2*a* formed by caulking the ball point pen tip A (a boundary line between a portion at which a caulking tool and the tip come into mutual contact and a portion at which they do not) and a corner portion 2*c* at the foremost distal end portion of the ball point pen tip exist at portions other than the portion with which the tangent L of the ball point pen tip comes into contact; and (3) the length of the portion F formed when a part near the opening of the inner surface of the ball point pen tip is brought into pressure contact with the ball 8 at the time of caulking (an ink control portion), in a longitudinal direction, is within the range of 15 to 35% of the ball diameter from an open end.

Figure 2:
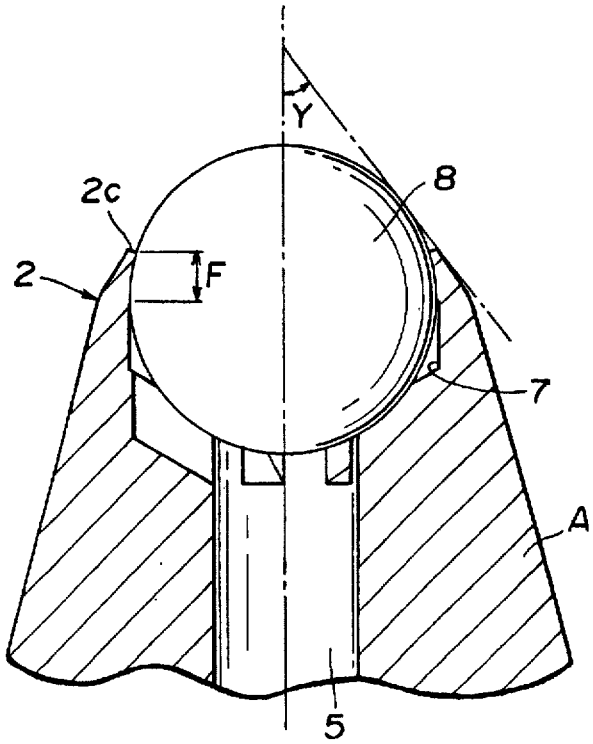
FIG. 2 is an explanatory view showing a comparative example with the structure of the ball point pen tip shown in FIG. 1.

In contrast, FIG. 2 shows a Comparative Example wherein the corner portion 2*c* at the foremost tip portion of the ball point pen tip exists at the portion with which the tangent L of the ball point pen tip comes into contact.

In FIG. 1 described above, the structure (1) prevents the ball point pen tip from coming into contact with the surface of a to-be-written object such as the surface of a sheet when writing is made while the writing instrument is kept inclined. When the degree of inclination of the writing instrument main body is increased and the writing instrument is laid down, the ball point pen tip and the surface of the to-be-written object come into mutual contact before long, but they do not come into mutual contact before the writing angle of 30° is reached. This angle is associated with the projection height of the ball and the distance (clearance) between the tip opening and the ball. In other words, the greater the projection height of the ball, or the smaller the distance between the tip opening and the ball, the smaller becomes the angle.

The structure (2) is to insure smooth feel of writing even when the tip A comes into contact with the surface of the to-be-written object during writing. When caulking is made, a corner is unavoidably formed in many cases at the boundary between the portion at which the caulking tool comes into contact-with the tip and the portion at which they do not. Generally, the side surface of the ball point pen tip is shaped in such a fashion that the diameter progressively decreases in multiple stages and even when the reduction of the diameter is great, the corner does not have an acute angle. Nonetheless, however obtuse this angle may be, catch will occur once the surface of the to-be-written object and the corner portion come into mutual contact. It is therefore necessary to avoid the formation of any portion which might result in catch, at portions of the ball point pen which have the possibility of coming into contact with the surface of the to-be-written object.

Next, the structure (3) means that the smooth feel of writing can be accomplished by mere prevention of catch on the surface of the to-be-written object but smooth rotation of the ball is indispensable. The ink control portion F described above is the portion which is formed when the inner wall of the ball point pen tip is pushed against the ball 8 at the time of caulking of the ball point pen tip, provides a uniform clearance from the ball and has a shape substantially similar to the shape of the ball. In practice, however, the shape is not completely similar because so-called "return" due to plastic machining of a metallic material (so-called "spring-back") is not uniform, but a curvature substantially approximate to an arcuate shape can be obtained.

When contact between the inner wall of the ball holding chamber 7 of the ball point pen tip and the ball is established by direct contact of metals, the frictional resistance becomes so great that the rotation of the ball is impeded. The ink existing inside the ball holding chamber 7 of the ball point pen tip plays the role of a lubricant for assisting the rotation of the ball, too, and to this end, an ink film must be formed over a certain area between the ball 8 and the inner wall of the ball holding chamber inside the ball holding chamber 7.

In order to form this ink film, it is necessary to prevent the ball and the inner wall of the ball holding chamber from coming into point or linear contact (or to bring them into surface contact), or the ink must have certain binding force (viscosity, tackiness, etc).

The ink control portion F is the portion at which the capillary force is high inside the ball holding chamber 7 and is the portion at which the ink always exists and at which the ink film is formed. The formation of a wide ink film in such a manner as to peripherally extend into the length of 15 to 35% of the ball diameter from the open end of the tip means that the ink control portion F is formed up to the position in the vicinity of the center of the ball, though this depends on the projection height of the ball. According to the experiments (Writing Test 1 in Tables 1A and 1B and Writing Test 2 in Tables 2A and 2B) listed below, a satisfactory lubrication effect cannot be obtained when the numerical value described above is smaller than 15%; and free movement of the ink is impeded, on the contrary, and the ink cannot be spread over the entire surface of the ball when the numerical value is greater than 35% (because a space like an ink reservoir exists to a certain extent inside the ball holding chamber).

In the Comparative Example shown in FIG. 2, catch with the surface of the sheet occurs and the writing resistance becomes greater than the sample shown in FIG. 1.

To evidence the range of the numerical value, ball point pen tips falling within this range and outside the range were produced, and writing tests were carried out. The results were as follows. Writing Test 1 (structure shown in FIG. 1):

Testing Condition machine used: line writing tester
(custom order product)

writing load: 200 g writing speed: 7 cm/s writing angle: 40° writing instrument used:
K105 (a product of Pentel K.K.)

ball diameter: 0.7 mm

Corner was not formed at a contact point between tangent and ball point pen tip (see FIG. 1).

The writing resistance value (g) under the writing condition described above was measured.

TABLE 1A

| ink control portion (%) | 5.7 | 10.0 | 15.7 | 20.0 |
|---|---|---|---|---|
| length (mm) | 0.04 | 0.07 | 0.11 | 0.14 |
| tangent angle (°) | | | | |
| 20° | 50 | 48 | 47 | 47 |
| 30° | 45 | 40 | 30 | 28 |
| 40° | 47 | 41 | 30 | 29 |
| 50° | 48 | 42 | 35 | 34 |

TABLE 1A-continued

| | | | | |
|---|---|---|---|---|
| 60° | –*1 | –*1 | –*1 | –*1 |
| 70° | –*1 | –*1 | –*1 | –*1 |

TABLE 1B

| ink control portion (%) | 25.7 | 30.0 | 34.3 | 40.0 |
|---|---|---|---|---|
| length (mm) | 0.18 | 0.21 | 0.24 | 0.28 |
| tangent angle (°) | | | | |
| 20° | 61*2 | 62*2 | 62*2 | 63*2 |
| 30° | 27 | 26 | 26 | 40*2 |
| 40° | 28 | 27 | 27 | 42*2 |
| 50° | 33 | 32 | 32 | 44*2 |
| 60° | –*1 | –*1 | –*1 | –*1 |
| 70° | –*1 | –*1 | –*1 | –*1 |

Writing Test 2 (Structure of Comparative Example shown in FIG. 2):

Testing Condition:

machine used: line writing tester (custom order product)

writing load: 200 g writing speed: 7 cm/s writing angle: 40° writing instrument used:

K105 (a product of Pentel K.K.) ball diameter: 0.7 mm

The structure wherein corner was positioned at contact point between tangent and ball point pen tip (se.e FIG. 2).

The writing resistance value (g) under the writing condition described above was measured.

TABLE 2A

| ink control portion (%) | 5.7 | 10.0 | 15.7 | 20.0 |
|---|---|---|---|---|
| length (mm) | 0.04 | 0.07 | 0.11 | 0.14 |
| tangent angle (°) | | | | |
| 20° | 52 | 48 | 50 | 60*2 |
| 30° | 48 | 43 | 33 | 31 |
| 40° | 63 | 56 | 45 | 44 |
| 50° | 68 | 62 | 56 | 54 |
| 60° | –*1 | –*1 | –*1 | –*1 |
| 70° | –*1 | –*1 | –*1 | –*1 |

TABLE 2B

| ink control portion (%) | 25.7 | 30.0 | 34.3 | 40.0 |
|---|---|---|---|---|
| length (mm) | 0.18 | 0.21 | 0.24 | 0.28 |
| tangent angle (°) | | | | |
| 20° | 62*2 | 62*2 | 63*2 | 63*2 |
| 30° | 30 | 29 | 29 | 41*2 |
| 40° | 43 | 42 | 42 | 57*2 |
| 50° | 53 | 53 | 52 | 65*2 |
| 60° | –*1 | –*1 | –*1 | –*1 |
| 70° | –*1 | –*1 | –*1 | –*1 |

Next, the structure of the ball point pen tip according to another embodiment of the present invention will be explained.

Figure 3:
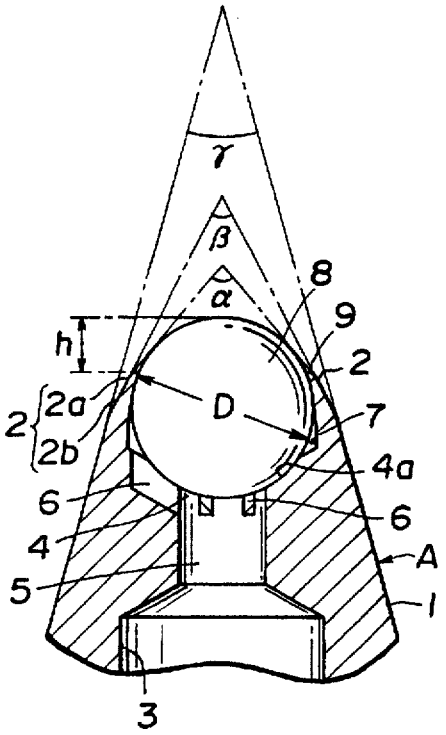
FIG. 3 is a sectional view of principal portions, showing the structure of a ball point pen tip according to the second embodiment of the present invention.

As shown in FIG. 3 which is a sectional view of principal portion of the ball point pen tip A of the present invention, the ball point pen tip A has a taper surface 1 the diameter of which progressively decreases towards the distal end thereof (upward in the drawing), and a reduced diameter portion 2 is formed by caulking inward the distal end of this taper surface 1. An ink passage 3 is formed as a connection hole inside the ball point pen tip A. A center hole 5 whose diameter is reduced by a plurality of inward projection portions 4 and which has a ball receiving seat portion 4*a* and ink grooves 6 are formed in the ink passage 3. The center hole 5 and the ink grooves 6 are open to the ball holding chamber 7 defined by the inward projection portions 4. The ball 8 is held by the ball holding chamber 7 and is prevented from jumping out by the reduced diameter portion 2. The distal end portion of the ball 8 protrudes from the tip open portion 9 of the reduced diameter portion 2. The projection distance h of the ball from the tip open portion 9 is the exposed height of the ball 8.

The reduced diameter portion 2 has two kinds of caulked portions having mutually different caulking angles. They are a first caulked portion 2*a* on the distal end side and a second caulked portion 2*b* continuing from this first caulked portion 2*a*. The taper angle $\gamma$ (the angle of diameter reduction of the taper surface) of the taper surface 1, the caulking angle $\alpha$ of the first caulked portion 2*a* and the caulking angle $\beta$ of the second caulked portion 2*b* are so set as to satisfy the relations, $\gamma+10° \leqq \beta \leqq \gamma+40°$ and $\beta+10° \leqq \alpha \leqq \beta+40°$. When $\gamma$ and $\alpha$ are substantially $0° \leqq \gamma$ and $\alpha<180°$, $\alpha$, $\beta$, and $\gamma$ satisfy the relations, $20° \leqq \alpha<180°$, $10° \leqq \beta<140°$ and $0° \leqq \gamma 100°$. The ball point pen tip A shown in the drawing has $\alpha$=about 80°, $\beta$=about 50°, $\gamma$=about 30°, h=about 0.200 mm, D=about 0.7 mm and t=about 0.020 mm.

The ink control portion 10 which corresponds to the reduced diameter portion 2 of the ball holding chamber 7 is the portion which is pushed against the ball 8 at the time of caulking and is peripherally formed. It is smooth and has a uniform clearance from the ball. Because this ink control portion 10 is smooth, ink movement becomes easy and ink can be easily applied to, and carried by, the ball. Because the ink control portion 10 has a uniform clearance from the ball 8, the quantity of ink carried by the ball and discharged to the surface of the to-be- written object becomes uniform, and density of written characters and uniformity of the writing width can be improved.

Here, ball point pen tips are produced by setting the caulking angle and the diameter reduction angles $\alpha$, $\beta$, $\gamma$ of the taper surface and the distance t between the outer shape of the small mouth portion at the distal end of the opening and the outer shape of the ball to various values, and catch of the tip to the surface of the to-be-written object (Test 1) and the density of written characters (Test 2) are tested for these ball point pen tips at a writing angle of 40°. Incidentally, as to the t value, samples having $\alpha$=80°, $\beta$=50°, $\gamma$=30° are produced and Tests 1 and 2 are carried out. The results are shown in Table 1 to Table 17. The ball point pen tips used for the tests have diameter reduction angles of 30° and 35° for the taper surface, and the caulking angle at which machining was impossible is represented by symbol "–".

The production method of the ball point pen tip used for the tests is as follows. First, the taper surface A of the ball point pen tip, the ball holding chamber 7 and the ink passage 3 are formed by cutting, or the like. The ink passage 3 is formed with the center hole 5 and the ink groove 6 in such a manner as to leave the inward projection portion 4, and then the ball 8 is loaded into the ball holding chamber 7. To hold this ball 8, the reduced diameter portion 2 at the distal end of the ball point pen tip A is formed by caulking.

[Test 1] (Catch test to the surface at writing angle 40°)

The writing test was carried out under the following test condition and catch between the ball point pen tip and the sheet surface was examined.

Evaluation:

○: No contact was made between ball point pen tip and sheet surface.

Δ: Contact existed between ball point pen tip and sheet surface and writing could be made, though friction sound occurs.

x: Ball point pen tip scratched sheet surface and uniform written line could not be obtained.

[Test 2] (Density test of written characters)

The writing test was carried out under the following test conditions and the number of occurrences of density change of written characters was counted.

Test Condition:

writing angle: 40° vertical writing load: 200 g writing distance: 100 m tester used: spiral writing tester (Seiki Kogyo Lab.)

test sheet used: NS55 recording sheet (K.K. Kubishi Kagakukikai Seisakusho)

writing instrument used: BK100 (oily ball point pen. Pentel K.K.)

tip material: ferrite stainless steel tip dimension: ball diameter 0.7 mm, ball projection height 0.200 mm

TABLE 3

| γ (°) | | | | | 30 | | | |
|---|---|---|---|---|---|---|---|---|
| α (°) | | | | | 30 | | | |
| β (°) | 30 | 40 | 50 | 60 | 70 | 80 | 90 | 100 |
| Test 1 | — | — | — | — | — | — | — | — |
| Test 2 | — | — | — | — | — | — | — | — |

TABLE 4

| γ (°) | | | | | 30 | | | |
|---|---|---|---|---|---|---|---|---|
| α (°) | | | | | 40 | | | |
| β (°) | 30 | 40 | 50 | 60 | 70 | 80 | 90 | 100 |
| Test 1 | — | x | — | — | — | — | — | — |
| Test 2 | — | 23 | — | — | — | — | — | — |

TABLE 5

| γ (°) | | | | | 30 | | | |
|---|---|---|---|---|---|---|---|---|
| α (°) | | | | | 50 | | | |
| β (°) | 30 | 40 | 50 | 60 | 70 | 80 | 90 | 100 |
| Test 1 | — | Δ | x | — | — | — | — | — |
| Test 2 | — | 5 | 24 | — | — | — | — | — |

TABLE 6

| γ (°) | | | | | 30 | | | |
|---|---|---|---|---|---|---|---|---|
| α (°) | | | | | 60 | | | |
| β (°) | 30 | 40 | 50 | 60 | 70 | 80 | 90 | 100 |
| Test 1 | — | ○ | ○ | Δ | — | — | — | — |
| Test 2 | — | 0 | 0 | 7 | — | — | — | — |

TABLE 7

| γ (°) | | | | | 30 | | | |
|---|---|---|---|---|---|---|---|---|
| α (°) | | | | | 70 | | | |
| β (°) | 30 | 40 | 50 | 60 | 70 | 80 | 90 | 100 |
| Test 1 | — | ○ | ○ | ○ | ○ | — | — | — |
| Test 2 | — | 0 | 0 | 3 | 6 | — | — | — |

TABLE 8

| γ (°) | | | | | 30 | | | |
|---|---|---|---|---|---|---|---|---|
| α (°) | | | | | 80 | | | |
| β (°) | 30 | 40 | 50 | 60 | 70 | 80 | 90 | 100 |
| Test 1 | — | ○ | ○ | ○ | ○ | ○ | — | — |
| Test 2 | — | 5 | 0 | 0 | 4 | 12 | — | — |

TABLE 9

| γ (°) | | | | | 30 | | | |
|---|---|---|---|---|---|---|---|---|
| α (°) | | | | | 90 | | | |
| β (°) | 30 | 40 | 50 | 60 | 70 | 80 | 90 | 100 |
| Test 1 | — | Δ | ○ | ○ | ○ | Δ | x | — |
| Test 2 | — | 8 | 2 | 0 | 0 | 10 | 45 | — |

TABLE 10

| γ (°) | | | | | 30 | | | |
|---|---|---|---|---|---|---|---|---|
| α (°) | | | | | 100 | | | |
| β (°) | 30 | 40 | 50 | 60 | 70 | 80 | 90 | 100 |
| Test 1 | — | x | Δ | ○ | ○ | Δ | Δ | — |
| Test 2 | — | 25 | 9 | 5 | 2 | 12 | 26 | 53 |

TABLE 11

| γ (°) | | | | | 35 | | | |
|---|---|---|---|---|---|---|---|---|
| α (°) | | | | | 30 | | | |
| β (°) | 30 | 40 | 50 | 60 | 70 | 80 | 90 | 100 |
| Test 1 | — | — | — | — | — | — | — | — |
| Test 2 | — | — | — | — | — | — | — | — |

TABLE 12

| | γ(°) 35 α(°) 40 β(°) | | | | | | | |
|---|---|---|---|---|---|---|---|---|
| | 30 | 40 | 50 | 60 | 70 | 80 | 90 | 100 |
| Test 1 | — | x | — | — | — | — | — | — |
| Test 2 | — | 35 | — | — | — | — | — | — |

TABLE 13

| | γ(°) 35 α(°) 50 β(°) | | | | | | | |
|---|---|---|---|---|---|---|---|---|
| | 30 | 40 | 50 | 60 | 70 | 80 | 90 | 100 |
| Test 1 | — | Δ | x | — | — | — | — | — |
| Test 2 | — | 11 | 24 | — | — | — | — | — |

TABLE 14

| | γ(°) 35 α(°) 60 β(°) | | | | | | | |
|---|---|---|---|---|---|---|---|---|
| | 30 | 40 | 50 | 60 | 70 | 80 | 90 | 100 |
| Test 1 | — | ○ | ○ | Δ | — | — | — | — |
| Test 2 | — | 9 | 3 | 12 | — | — | — | — |

TABLE 15

| | γ(°) 35 α(°) 70 β(°) | | | | | | | |
|---|---|---|---|---|---|---|---|---|
| | 30 | 40 | 50 | 60 | 70 | 80 | 90 | 100 |
| Test 1 | — | ○ | ○ | ○ | ○ | — | — | — |
| Test 2 | — | 6 | 0 | 1 | 16 | — | — | — |

TABLE 16

| | γ(°) 35 α(°) 80 β(°) | | | | | | | |
|---|---|---|---|---|---|---|---|---|
| | 30 | 40 | 50 | 60 | 70 | 80 | 90 | 100 |
| Test 1 | — | ○ | ○ | ○ | ○ | ○ | — | — |
| Test 2 | — | 7 | 0 | 0 | 2 | 22 | — | — |

TABLE 17

| | γ(°) 35 α(°) 90 β(°) | | | | | | | |
|---|---|---|---|---|---|---|---|---|
| | 30 | 40 | 50 | 60 | 70 | 80 | 90 | 100 |
| Test 1 | — | Δ | ○ | ○ | ○ | Δ | x | — |
| Test 2 | — | 8 | 1 | 0 | 0 | 16 | 50 | — |

TABLE 18

| | γ(°) 35 α(°) 100 β(°) | | | | | | | |
|---|---|---|---|---|---|---|---|---|
| | 30 | 40 | 50 | 60 | 70 | 80 | 90 | 100 |
| Test 1 | — | x | Δ | ○ | ○ | ○ | Δ | x |
| Test 2 | — | 28 | 7 | 0 | 2 | 12 | 28 | 57 |

TABLE 19

| | γ(°) 80 α(°) 50 t(μm) | | | | | |
|---|---|---|---|---|---|---|
| | 5 | 7 | 10 | 20 | 30 | 35 |
| Test 1 | ○ | ○ | ○ | ○ | Δ | x |
| Test 2 | 15 | 0 | 0 | 0 | 3 | 23 |

The ball point pen tip according to the present invention does not cause catch with the written surface at a small writing angle and can obtain beautiful written characters having a uniform density.

Figure 4:
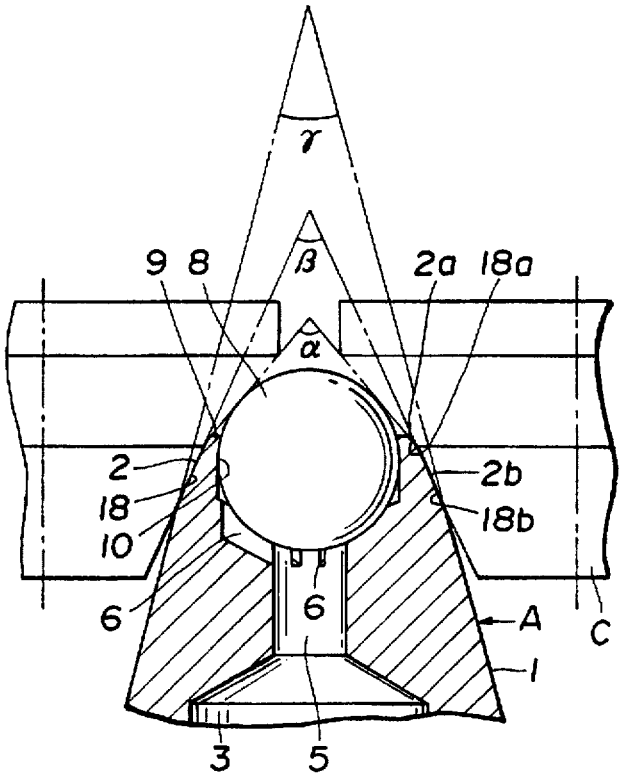
FIG. 4 is an explanatory view showing the first example of the production method of the ball point pen tip according to the second embodiment of the present invention.

FIG. 4 is an explanatory view showing a production method of a ball point pen tip according to the present invention. First, the side wall taper surface 1 of the body member or ball point pent tip A, the ball holding portion or chamber 7 for accommodating the ball 8, the ink passage 3 for passing ink to the ball holding chamber 7 and the center hole 5 are formed, and then the ball 8 is loaded into the ball holding chamber 7. Next, to hold this ball 8, the butt end portion 2 of the ball point pen tip A is caulked so as to form the caulked portions 2*a*, 2*b*.

A pressure contact portion 18 of the caulking tool or apparatus C which comes into contact with the ball point pen tip A includes a first pressure contact surface 18*a* for forming the first caulked portion 2*a* near the butt end portion 2 of the ball point pen tip A and a second pressure contact portion 18*b* so formed as to continue from the first pressure contact surface at a different caulking angle from the first pressure contact surface. The first pressure contact surface 18*a* is shaped in such a manner that a part of its extension comes into contact with the ball 8, and machining of the caulked portion 2 is completed at the position at which the first pressure contact surface 18*a* comes into contact with the ball 8.

Because the caulking apparatus C applies caulking so that the pressure contact surface of the pressure contact portion 18 comes into contact with the ball, the end point of caulking is constant but does not vary. In other words, because the caulking angle and the size of the caulked portion do not fluctuate, production can be stably carried out. Because the first caulked portion 2*a* and the second caulked portion 2*b* are formed by the continuous pressure contact surfaces 18*a* and 18*b*, protrusions as non-uniform wall thickness portions and fins (not shown) are not formed at the boundary portion of the caulked portions having different caulking angles.

Here, the caulking angle of the pressure contact surface is preferably set, as shown in FIG. 4, so that the caulking angle α of the first pressure contact surface 18*a* forming the first caulked portion, the caulking angle β of the second pressure contact surface 18*b* and the taper angler γ of the side wall taper surface of the ball point pen tip A other than the caulked portion 2 satisfy the relations, $\gamma+10° \leqq \beta \leqq \gamma+30°$ and $\beta+10° \leqq \alpha \leqq \beta+30°$.

The number of occurrences of "hollowed writing" (the phenomenon in which portions not applied with ink occur during writing) is examined for the ball point pen tips wherein the first caulked portion 2*a* and the second caulked portion 2*b* are formed in one production step and for the ball point pen tips wherein they are formed in two separate production steps (Test 1). The results are tabulated in Table 20.

TABLE 20

| | angle α | | |
|---|---|---|---|
| | 60° | 70° | 80° |
| | angle β | | |
| | 40° | 50° | |
| one step | 12 | 11 | 12 |
| two steps | 40 | 55 | 68 |

Test Condition:

writing angle: 70° vertical writing load: 200 g writing distance: 200 m tester used: Spiral writing tester (Seiki Kogyo Lab)

test sheet used: NS55 recording sheet (K.K. Kubishi Kagakukikai Seisakusho)

writing instrument used: BK 100 (oily ball point pen, Pentel K.K.)

tip material: ferrite stainless steel tip dimension: ball diameter 0.7 mm, ball projection height 0.21 mm, taper angle (β) of tip side portion 30°

The relation between the first caulking angle α and the second caulking angle β is examined by an oblique writing test (Test 2). The results are tabulated in Table 21.

TABLE 21

| | β = 40° | β = 50° |
|---|---|---|
| α = 50° | ○ | — |
| α = 60° | ○ | ○ |
| α = 70° | ○ | ○ |
| α = 80° | x | ○ |
| α = 85° | x | x |

Test Condition:

writing angle: 45° vertical writing load: 200 g writing distance: 200 m tester used: Spiral writing tester (K.K. Kubishi Kagakukikai Seisakusho)

test sheet used: NS55 recording sheet (K.K. Kubishi Kagakukikai Seisakusho)

writing instrument used: BK 100 (oily ball point pen, Pentel K.K.)

tip material: ferrite stainless steel tip dimension: ball diameter 0.7 mm, ball projection height 0.21 mm, taper angle (γ) of tip side portion 30°

Figure 5:
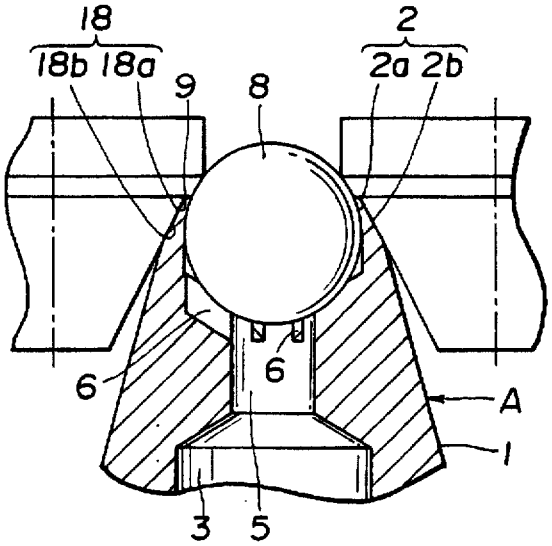
FIG. 5 is an explanatory view showing the second example of the production method of the ball point pen tip according to the present invention.

Evaluation:

○: uniform and continuous writing distance of at least 50 m x: uniform and continuous writing distance of 0 to less than 50 m FIG. 5 shows the production method according to another embodiment of the present invention. This embodiment is fundamentally the same as the embodiment shown in FIG. 2 but is different in that the first caulked portion 2a has a curvature. An increase in the caulking angle of the first pressure contact surface 18a forming the first caulked portion decreases the space between the ball 8 and the butt end portion 2. Therefore, the pressure contact surface is shaped into a recessed curved surface. In the example shown in the drawing, the first caulked portion 2a has a curved surface having a radius 5 to 30% of the diameter of the ball 8. With this arrangement, the contact between the ball point pen tip and the written surface becomes smooth during writing. The "hollowed writing" phenomenon can be reduced to minimum by reducing the space between the ball 8 and the butt end portion 2. In other words, one of the causes for the occurrence of this "hollowed writing phenomenon" is air entering the ball point pen tip due to the rotation of the ball 8, and when the space between the ball 8 and the butt end portion 2 is reduced to minimum, air is not likely to enter the ball point pen tip and the "hollowed writing phenomenon" can be minimized.

As shown in the drawing, the caulking angle of the pressure contact surface is preferably set so that the caulking angle β of the second pressure contact surface 18b and the taper angle γ of the side wall taper surface of the ball point pen tip A other than the caulked portion 2 satisfy the relation, $\gamma+10° \leqq \beta \leqq \gamma+30°$.

Various other modifications can be made besides the example described above. For example, diameter reduction machining can be made in advance to some extents before caulking in order to minimize the load to the tool, and not only the first pressure contact surface 18a but also the second pressure contact surface 18b can be shaped into the curved surface. A so-called "pipe type ball point pen" wherein the ink communication groove 6 and the center hole 5 are formed by pressing a metallic pipe can be used for the ball point pen tip.

The number of occurrences of the "hollowed writing phenomenon" is examined for the ball point pen tips whose first caulked portion 2a has a curved surface (Test 3). The results are tabulated in Tables 22 and 23.

TABLE 22

| | | | | | | |
|---|---|---|---|---|---|---|
| ① | 0.02 | 0.05 | 0.10 | 0.20 | 0.25 | 0.30 |
| ② | 2.8 | 7.1 | 14.3 | 28.6 | 35.6 | 42.8 |
| β | | | 40° | | | |
| ③ | 16 | 7 | 8 | 12 | 18 | 23 |
| ④ | 51 | 27 | 35 | 40 | 54 | 65 |

① radius of curved surface (mm)

② proportion of radius of curvature to ball diameter (%) = radius of curved surface (mm) × 100/ball diameter (mm)

③ one production step

④ two production steps

Test Condition:

writing angle: 70° vertical writing load: 200 g writing distance: 200 m tester used: Spiral writing tester (Seiki Kogyo Lab)

test sheet used: NS55 recording sheet (K.K. Kubishi Kagakukikai Seisakusho)

writing instrument used: BK100 (oily ball point pen, Pentel K.K.)

tip material: ferrite stainless steel tip dimension: ball diameter 0.7 mm, ball projection height 0.21 mm, taper angle (γ) of tip side portion 30°

TABLE 23

| | | | | | | |
|---|---|---|---|---|---|---|
| ① | 0.02 | 0.05 | 0.10 | 0.20 | 0.25 | 0.30 |
| ② | 2.8 | 7.1 | 14.3 | 28.6 | 35.6 | 42.8 |
| β | | | 50° | | | |
| ③ | 14 | 5 | 7 | 10 | 15 | 20 |
| ④ | 48 | 26 | 32 | 38 | 52 | 63 |

① radius of curved surface (mm)

② proportion of radius of curvature to ball diameter (%) = radius of curved surface (mm) × 100/ball diameter (mm)

③ one production step

④ two production steps

Test Condition:

writing angle: 70° vertical writing load: 200 g writing distance: 200 m tester used: Spiral writing tester (Seiki Kogyo Lab)

test sheet used: NS55 recording sheet (K.K. Kubishi Kagakukikai Seisakusho)

writing instrument used: BK 100 (oily ball point pen, Pental K.K.)

tip material: ferrite stainless steel tip dimension: ball diameter 0.7 mm, ball projection height 0.21 mm, taper angle (γ) of tip side portion 30°

The production method of the ball point pen tip according to the present invention described above limits the complicated work and can produce the ball point pen tip having excellent writing feel and writing quality.

Figure 6:
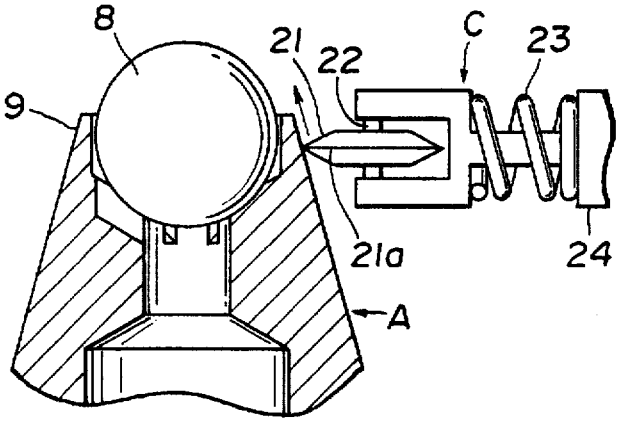
FIGS. 6, 7 and 8 are views each showing a structural example of a caulking tool for practicing the production method of the ball point pen tip according to the present invention.
Figure 7:
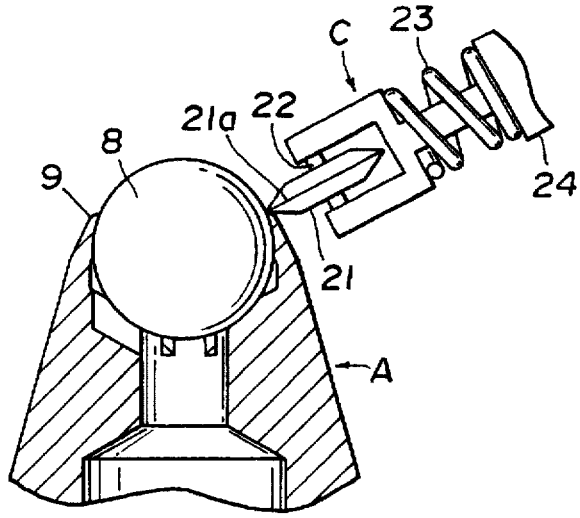

FIGS. 6 and 7 are sectional view of the principal portions when caulking is applied to the ball point pen tip A by using a preferred caulking tool C. FIG. 6 shows the start point of caulking and FIG. 7 shows its end point.

The caulking tool C described above has a rotary pressure contact member 21 which rotates at the center of a rotary shaft 22. The rotary shaft 22 is fitted, through a spring 23 as a flexible member for absorbing an excessive push force, to a holder 24 connected to a position movement controller (not shown). A pressure contact portion 21*a* of the rotary pressure contact member 21 is moved in a direction of the tip open portion 9 of the ball point pen tip A (in the direction indicated by an arrow in FIG. 6) while being rotated round the ball point pen tip A (see FIG. 7). The smaller the width of this pressure contact portion 21*a*, the less frequent is the occurrence of the stress to the push position and the greater becomes an escape portion of the resulting stress. However, because the distance to the tip open portion 9 becomes great in this case, the width is preferably 5 to about 30% of the width of the portion to be caulked.

Figure 8:
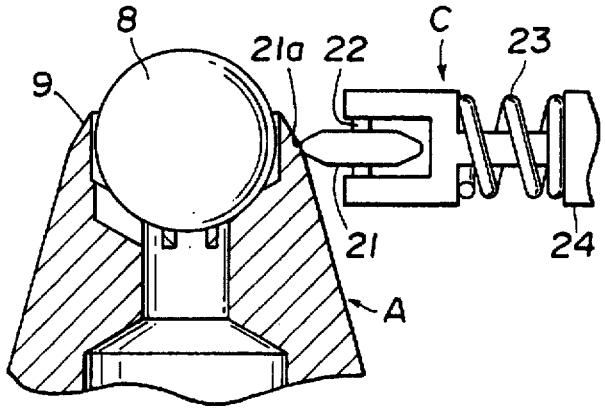

FIG. 8 shows still another embodiment, and depicts the end point of machining corresponding to FIG. 7. The differences of this embodiment from the embodiments shown in FIGS. 5 and 7 are that the contact portion with the ball point pen tip is provided with a gradual curved surface by changing the shape of the rotary push member and that the shape of the tip open portion 9 before machining is different. Besides the metal, a rubber, a synthetic resin, ceramics, etc, can be used as the material of the rotary push member 22, and the shape need not be changed in accordance with the material. However, when a relatively soft material such as the rubber or the synthetic resin is selected, the thickness of the tip open portion 9 of the ball point pen tip A is preferably reduced before machining as shown in FIG. 8. If the thickness is great for this soft material, the load to the thick portion 22 becomes great and service life of the tool might be relatively reduced.

As a modified embodiment of this embodiment, a plurality of rotary push members may be simultaneously brought into contact with the ball point pen tip, or the push force of the rotary push member may be kept at a constant value as a whole but is changed in accordance with the contact position. The ball point pen may be a ball point pen of a type (pipe type ball point pen) wherein a part of the side portion of a pipe member is deformed so as to form an inward projection portion and the ball is placed at this projection portion.

In the various production methods of the ball point pen tip described above, the corner portions can be shaped into a curvature shape by causing fine granules to impinge against at least the reduced diameter portion 2 after the ball 8 is held. Such an embodiment will be described.

In other words, a blank having a reduced diameter portion formed by a caulking tool and holding a ball is put into a hexagonal prismatic sample pot of a centrifugal fluidization barrel (model HS-1-4V, a product of Tipton Espo K.K.) with SF-8D (pulverized corn seed with an average particle diameter of about 1.5 mm) as a fine granular grinding material and with chromium oxide powder (average grain size 3 μm) for grinding, a product of Tipton Espo K.K., and is treated for 3 hours at 280 rpm with a radius of rotation of 120 mm

.

The blank to be treated has a ball of a cemented carbide having a ball diameter of about 0.7 mm, a diameter reduction angle of about 30° at the taper portion, a caulking angle of about 80° at the distal end side, a caulking angle of about 52° on the reduced diameter side, a ball projection distance of the ball of about 0.2 mm from the open portion and a thickness of about 0.01 mm at the tip distal end. The fine granular member consisting of SF-8D put into the sample pot with the blank should account for 30 to 70% of the pot volume per 100 to 500 blanks, and 50% of SF-8D is put in this example. Though the volume of chromium oxide powder for grinding is preferably from 1 to 10%, this example uses a volume of 5%.

As the fine granular member and the blank are rapidly stirred inside the sample pot, the fine granular member uniformly impinges against the surface of the blank, and the corner portions on the blank surface are ground and/or deformed into the curved surface shape. In this case, composite powder of chromium oxide power for grinding and SF-8D apparently forms one grinding particle with SF-8D being the base. After this treatment, the surface of the ball point pen tip A so obtained has a mirror surface, and does not easily cause catch on the written surface such as a paper surface in writing. Moreover, it can provide high quality appearance. In addition to the distal end portion, the corner portions (not shown) at the rear end of the step portion between the large diameter portion and the reduced diameter portion can be shaped into the curved surface, as well, and the surface of the reduced portion as the joint portion with the ink tank (not shown) can be shaped into the mirror surface. Therefore, the problem of ink leakage, too, can be minimized.

Incidentally, since chromium oxide used as the fine granular member locally attains a high temperature and a high pressure at the machined portion, it is under the state of metallic chromium and chromium ions. This chromium diffuses into the stainless materials, increases the quantity of chromium on the surface and improves corrosion- and wear-resistance. Generally, those alloys which have a large chromium content have low cuttability and for this reason, it has been difficult to form a ball point pen tip by using materials having a high chromium content from the beginning. However, the production method of this embodiment can obtain a ball point pen tip having excellent corrosion- and wear- resistance.

The combination of the granular members used is not limited to the example given above. For example, SF-14 (pulverized) walnut shells with an average particle size of about 1.2 mm), a product of Tipton Espo K.K., may be used in place of SF-8D of Tipton Espo K.K., and chromium nitride powder and chromium carbide powder may be used in place of chromium oxide powder. Though the radius of rotation for rotating the sample pot is suitably from 100 to about 200 mm, the number of revolutions may be suitably set in accordance with the radius of rotation. The number of revolutions is preferably within the range of 100 to 400 rpm. Further, the treatment time is from 10 to 300 minutes. When brass or german silver is used as the material, however, the treatment time is preferably from 10 to 30 minutes.

Another example will be given.

This example uses the same blank as the one used in the example described above, and two kinds of silicon carbide powder having particle sizes of 1.5 mm and 1.2 μm, as the grinding agent. These blank and grinding agent are put into the sample pot of the centrifugal fluidization barrel with cooling water and a surfactant (Model LC-2, a product of Tipton Espo K.K.) for removing dust of the blank, and treatment is carried out at 220 rpm for 30 minutes with a radius of rotation of 170 mm, in the same way as in the example given above.

In the same way as in the example given above, 50% of silicon carbide powder having a particle size of 1.5 mm per 100 to 500 blanks, in terms of the volume of the sample pot, and 5% of silicon carbide powder having a particle size of 1.2 μm are put into the sample pot, and 600 cc of cooling water and 10 ml of the surfactant (Model LC-2) are added.

Since this example uses silicon carbide powder having a large particle size of 1.5 mm and a relatively large mass, a relatively strong impact force can be applied to the blank surface. Great work hardening of the material occurs at the distal end portion having a large machining ratio, and a ball point pen tip having excellent durability can be obtained.

Still another example will be explained.

This example uses the same blank as those of the foregoing examples, and a ball point pen tip is produced by using an apparatus which blasts the fine granular member with high pressure air to this blank. This example uses PNEUMA BLASTER SL-3, a product of Fuji Seisakusho K.K., and Morrundum A #1200 (silicon carbide powder, average particle size of 9.5 μm), a product of Showa Denko K.K., as the fine granular member.

The blasting condition of the fine granular member to the portion of the blank corresponding to the tip butt end portion is as follows. The fine granular member is blasted at a jet air pressure of 3.5 kg/cm$^2$ at an angle of 45° from the longitudinal direction of the tip and from a distance of about 300 mm from the blank while the blank is rotated once/sec for about 5 seconds.

In the ball point pen tip obtained by this example, the corner portions on the blank surface are polished and/or deformed into the curved surface, and since a large number of fine concavo-convexities are formed, the surface condition has a so-called satin finished surface.

As described above, the production method of the ball point pen according to the present invention can minimize the occurrence of catch of the corner portions 4 with the to-be-written object such as paper during writing, can extremely stabilize ink discharge and can reduce the occurrence of the so-called "hollowed writing phenomenon" and the "blurr".

Next, fine machining lines, scratches and fins are unavoidably formed at the distal end portion of the ball point pen due to cutting for shaping the outer shape and caulking. They cause catch with the surface of the to-be-written article such as the sheet surface and not only increases the frictional resistance at the time of writing but also scratches the surface of the to-be-written object. Since ink permeates into the scratches, distortion of writing occurs. Therefore, it is desirable and necessary to shape the outer shape of the ball point pen, particularly the outer shape of the tip portion which is most likely to come into contact with the written surface, into a smooth curve shape.

To accomplish this object, it has been customary to conduct so-called "polishing" by causing a polishing member obtained by applying a fine polishing material such as powder of chromium oxide or silicon carbide to a cloth such as a felt or cotton to move relatively while keeping contact with the ball point pen tip surface.

In an embodiment of the present invention, the synthetic resin pipe used as the ink tank is connected to the ball point pen tip, and is rotated while it is held to rotate the tip so as to bring the polishing material into contact with the distal end portion at the position at which the synthetic resin pipe undergoes deflection and to apply the polishing work to the contact portion. In this way, even when the contact force of the polishing material coming into contact with the ball point pen tip is somewhat excessive, the excessive contact force can be absorbed by the deflection of the synthetic resin pipe. The fine adjustment of the contact force can be made easily and reliably by adjusting the holding position of the synthetic resin pipe and its distance from the polishing material.

Figure 9:
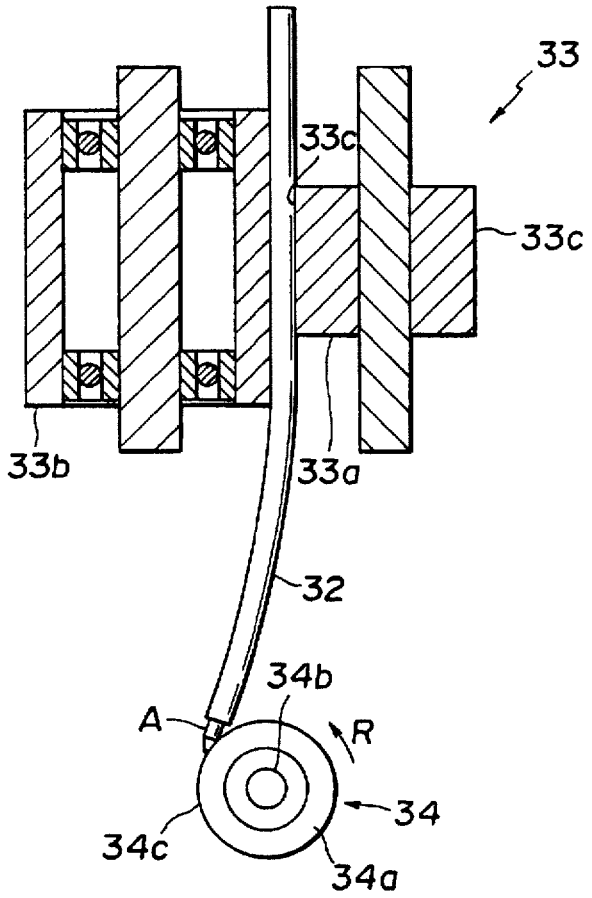
FIGS. 9 and 10 are explanatory views each showing a method of polishing a distal end portion of the tip by rotating a synthetic resin pipe having the ball point pen tip fitted thereto.
Figure 10:
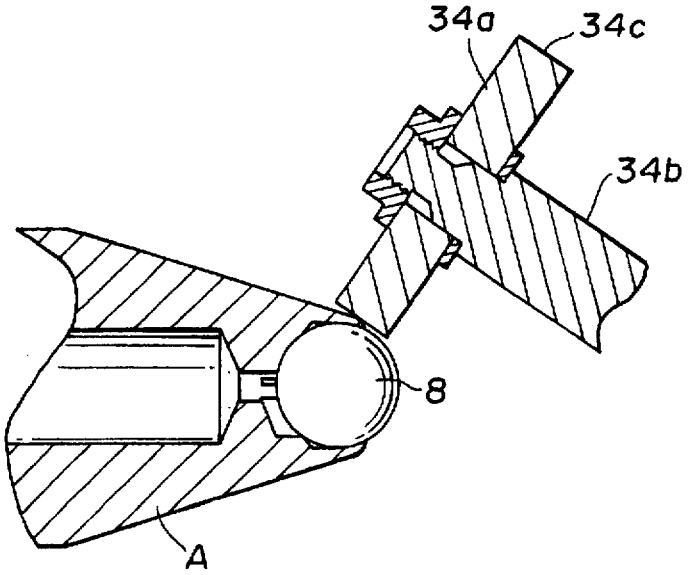

FIGS. 9 and 10 show an example where the synthetic resin pipe is deflected and the polishing material is brought into contact with the distal end portion, so as to apply polishing to the contact portion.

In FIG. 9, a grinder 34 having a rotating device 33 for rotating the synthetic resin pipe 32 having the ball point pen tip A fitted thereto and a polishing material **34*a* for polishing the distal end portion of the ball point pen tip A is used. The rotating device 33 includes a rubber roll 33*a* for imparting the rotating force to the synthetic resin pipe 32 and a reception roller 33*b*, and the synthetic resin pipe 32 is held between these rubber rollers 33*a* and reception roller 33*b*. In order to facilitate the rotation of the synthetic resin pipe 32, protuberances or projections are formed on the contact surface 33*c* of the rubber roller 33*a* with the synthetic resin pipe 32 in a direction parallel to the longitudinal direction of the synthetic resin pipe 32 so as to increase the coefficient of friction. To prevent the contact surface 33*c* with the pipe 32 of the reception roller 33*b* from damaging the synthetic pipe 32, a synthetic resin sheet or a cloth may be bonded to the contact surface 33*c* of the reception roller 33*b* or this roller 33*b*** itself may be shaped from a synthetic resin.

The grinder 34 includes a grinding material **34*a* which rotates with a rotary shaft 34*b* being the center and brings the polishing surface 34*c* at the side portion into contact with the material. The polishing surface 34*c* is shaped from a cloth or a fiber bundle such as a felt and a cotton, or a leather, and when brought into contact with the ball point pen tip A while rotating, it removes corners, fine machining lines, scratches, fins, etc, formed on the outer shape of the ball point pen tip A and shapes the outer shape into a smooth curved surface. The polishing effect can be improved by applying fine powder of chromium oxide, silicon carbide, aluminum oxide, diamond, etc. to the polishing surface 34c**.

The contact position between the polishing material 34a and the ball point pen tip A is deviated from the position at which the rotating device 33 holds the synthetic resin pipe 32. In this way, the synthetic resin pipe 32 is allowed to undergo deflection. This deflection quantity can be adjusted by adjusting the distance between the holding position of the synthetic resin pipe 32 by the rotating device 33 as the support point and the contact portion of the polishing material 34a with the ball-point pen A. In other words, this distance is increased when a great deflection quantity is necessary, and is decreased when a small deflection quantity is necessary. Here, when the rotating direction of the polishing material 34a is set to the rotating direction R as shown in the drawing, the powder polishing material cannot easily enter the inner hole of the ball point pen tip; hence, this structure is preferable.

Further, if the rotary shaft 34b is further deviated by 90° from the position in FIG. 7 and polishing is conducted in the vertical direction with respect to the longitudinal direction of the ball point pen tip A as shown in FIG. 10, durability of the polishing material can be improved and life becomes longer desirably.

What is claimed is:

1. A ball point pen tip comprising: a body member having a recess containing a ball, a caulked portion formed by a caulking tool for retaining the ball in the recess, first corner portions disposed at a foremost end portion of the body member, and second corner portions defining a boundary between the caulked portion and a portion of the body member which is not contacted by the caulking tool during formation of the caulked portion; wherein an angle defined between a tangential line coming into contact with both the ball and the body member and a center line of the ball point pen tip is within the range of 30° to 50°, the tangential line coming into contact with the caulked portion of the body member but not with the first and second corner portions thereof; and wherein the length of a portion of an inner surface of the recess from an opening thereof which is brought into pressure contact with the ball when the caulked portion is formed by the caulking tool is within the range of 15% to 35% of a diameter of the ball.

2. A ball point pen tip according to claim 1; wherein the caulked portion is disposed between the first and second corner portions.

3. A ball point pen tip comprising: a distal end portion; a taper surface having a diameter progressively decreasing towards the distal end portion; a reduced diameter portion formed by caulking the distal end portion inwardly and defining first and second caulked portions having mutually different caulking angles; a ball holding portion; an ink passage communicating with the ball holding portion; and a ball disposed in the ball holding portion and projecting outwardly from an opening thereof; wherein a caulking angle $\alpha$ of the first caulked portion, a caulking angle $\beta$ of the second caulked portion, a diameter reduction angle $\gamma$ of the taper surface, a diameter D of the ball, a projection height h of the ball from the opening of the ball holding portion, and a distance t between an outer surface of the distal end portion proximate the opening of the ball holding portion and an outer surface of the ball satisfy the following relations (1) to (4):

$$0.25D \leqq h \leqq 0.35D \quad (1)$$

$$0.007\ \text{mm} \leqq t \leqq 0.030\ \text{mm} \quad (2)$$

$$\gamma+10° \leqq \beta \leqq +40° \quad (3)$$

$$\beta+10° \leqq \alpha \leqq \beta+40° \quad (4).$$

4. A method of manufacturing a metallic ball point pen tip, comprising the steps of: providing a body member having a distal end portion and a ball holding portion; disposing a ball in the ball holding portion; and forming a plurality of caulked portions having different angles throughout the entire periphery of an outer surface of the distal end portion of the body member using a caulking tool while bringing a pressure contact portion of the caulking tool into contact with the ball.

5. A manufacturing method according to claim 3; wherein the pressure contact portion of the caulking tool comprises a plurality of continuous pressure contact surfaces having different caulking angles; and wherein the forming step includes bringing the pressure contact surfaces into pressure contact with the ball point pen tip to form the plurality of caulked portions in a single process.

6. A manufacturing method according to claim 5; wherein one of the pressure contact surfaces of the pressure contact portion comprises a recessed curved surface; and wherein the forming step includes bringing the recessed curved surface into contact with the distal end portion of the body.

7. A method of manufacturing a ball point pen tip, comprising the steps of: providing a body member having an open end at a distal end portion thereof and a recess containing a ball; bringing a contact surface of a rotary pressure contact member of a caulking mechanism into contact with the distal end portion of the body member while the pressure contact member is allowed to rotate on its own axis around the body member; and imparting a pressing deformation force to the distal end portion of the body member while moving the contact surface of the rotary pressure contact member towards the open end of the body member to form a reduced diameter portion around a periphery of the distal end portion for holding the ball in the recess so that the ball protrudes partially from the recess.

8. A method of manufacturing a ball point pen tip, comprising the steps of: providing a body member having an open end at a distal end portion thereof and a recess containing a ball; pressing the distal end portion of the body member to form a reduced diameter portion so that the ball is allowed to be retained in and partly protrude from the recess; and thereafter causing a fine granular member to impinge against at least the reduced diameter portion of the body member to form corner portions having a curved surface.

9. A method of manufacturing a ball point pen tip, comprising the steps of: providing a body member having a reduced diameter portion at a distal end thereof and a recess containing a ball; connecting the body member to a rotatable, deflectable synthetic resin pipe for rotation therewith; and polishing the reduced diameter portion of the body member into a smooth curved shape by bringing a polishing member into contact with the distal end of the body member while rotating the synthetic resin pipe and while allowing the rotating synthetic pipe to deflect.

10. A ball point tip for use in a ball point pen, the ball point tip comprising: a tubular body member having a first open end, a spherical ball retained in the first open end, a second open end opposite the first open end for receiving writing fluid, and a wall having a caulked portion formed by a caulking tool for retaining the spherical ball in the first open end, the wall having first corner portions disposed at a foremost end portion of the tubular body member and second corner portions defining a boundary between the caulked portion and a portion of the tubular body member which is not contacted by the caulking tool during formation of the caulked portion; wherein an angle defined between a tangential line tangent to both the spherical ball and the wall and a center line of the ball point tip is within the range of 30° to 50°, the tangential line coming into contact with the caulked portion of the tubular body member but not with the first and second corner portions thereof.

11. A ball point tip according to claim 10; wherein the caulked portion of the wall is formed by a caulking device while pressing an inner surface portion of the wall corresponding to the caulked portion into pressure contact with the spherical ball; and wherein the length of the inner surface portion of the wall from the first open end thereof which is pressed into pressure contact with the spherical ball is within the range of 15% to 35% of a diameter of the spherical ball.

12. A ball point tip according to claim 10; wherein the caulked portion is disposed between the first and second corner portions.

13. A method of manufacturing a ball point tip of a ball point pen, comprising the steps of: providing a tubular body member having a ball holding portion at a first open end thereof, a spherical ball disposed in the ball holding portion, and a second open end opposite the first open end for receiving writing fluid; and pressing a portion of the tubular body member proximate the first open end using a caulking device while bringing a pressure contact portion of the caulking device into contact with the spherical ball to form a plurality of caulked portions for retaining the spherical ball in the ball holding portion.

14. A manufacturing method according to claim 13; wherein the pressure contact portion of the caulking device comprises a plurality of continuous pressure contact surfaces having different caulking angles; and wherein the pressing step comprises bringing the pressure contact surfaces of the caulking device into pressure contact with the portion of the tubular body member to form the plurality of caulked portions having different caulking angles.

15. A manufacturing method according to claim 14; wherein one of the pressure contact surfaces of the caulking device comprises a recessed curved surface; and wherein the pressing step comprises bringing the recessed curved surface into contact with the portion of the tubular body member.

* * * * *